US009336970B2

(12) United States Patent
Koeda et al.

(10) Patent No.: US 9,336,970 B2
(45) Date of Patent: May 10, 2016

(54) DISCONNECTING SWITCH

(71) Applicant: PANASONIC CORPORATION, Osaka (JP)

(72) Inventors: Ryousuke Koeda, Hokkaido (JP); Shingo Watanabe, Hokkaido (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 252 days.

(21) Appl. No.: 14/349,949

(22) PCT Filed: Oct. 12, 2012

(86) PCT No.: PCT/JP2012/076531

§ 371 (c)(1),
(2) Date: Apr. 4, 2014

(87) PCT Pub. No.: WO2013/054924

PCT Pub. Date: Apr. 18, 2013

(65) Prior Publication Data

US 2014/0251779 A1 Sep. 11, 2014

(30) Foreign Application Priority Data

Oct. 13, 2011 (JP) ..... 2011-225960
Oct. 13, 2011 (JP) ..... 2011-225963

(51) Int. Cl.
*H01H 3/42* (2006.01)
*H01H 3/04* (2006.01)
(Continued)

(52) U.S. Cl.
CPC ..... *H01H 21/22* (2013.01); *H01H 3/04* (2013.01); *H01H 3/42* (2013.01); *H01H 31/24* (2013.01); *H01H 1/20* (2013.01); *H01H 9/16* (2013.01)

(58) Field of Classification Search
CPC ..... H01H 3/02; H01H 3/04; H01H 3/42; H01H 21/22; H01H 31/24
USPC ..... 200/556, 331–338, 400, 401; 218/7, 78, 218/153, 154
See application file for complete search history.

(56) References Cited

U.S. PATENT DOCUMENTS 4,158,119 A * 6/1979 Krakik ..... H01H 71/501 200/401
5,003,139 A * 3/1991 Edds ..... H01H 71/0214 200/401

(Continued)

FOREIGN PATENT DOCUMENTS

JP 16-4895 Y 4/1941
JP 49-1822 U 1/1974

(Continued)

OTHER PUBLICATIONS

International Search Report issued in International Application No. PCT/JP2012/076531 mailed Nov. 6, 2012, with English translation, 4 pgs.

*Primary Examiner* — Amy Cohen Johnson
*Assistant Examiner* — Marina Fishman
(74) *Attorney, Agent, or Firm* — McDermott Will & Emery LLP

(57) ABSTRACT

A disconnecting switch includes a contact part that includes a stationary contact and a movable contact, a shaft that moves the movable contact relative to the stationary contact, an open/close mechanism part that moves the shaft back and forth freely between a closed contact position at which the movable contact contacts with the stationary contact and an open contact position at which the movable contact is separated from the stationary contact, and a housing that houses at least the contact part and the shaft. The open/close mechanism part includes an operation lever, an arm that rotates according to an operation of the operation lever to move the shaft between the open contact position and the closed contact position, and a wheel rotatably attached to the housing. The arm has a rotation slot in which the wheel is placed so that the wheel moves when the arm rotates.

9 Claims, 6 Drawing Sheets

(51) Int. Cl.

| | |
|---|---|
| ***H01H 3/02*** | (2006.01) |
| ***H01H 21/22*** | (2006.01) |
| ***H01H 31/24*** | (2006.01) |
| *H01H 1/20* | (2006.01) |
| *H01H 9/16* | (2006.01) |

(56) References Cited

U.S. PATENT DOCUMENTS

| | | | | |
|---|---|---|---|---|
| 5,270,564 | A * | 12/1993 | Parks | H01H 71/501 200/401 |
| 6,755,673 | B2 | 6/2004 | Fukushima et al. | |
| 8,581,128 | B2 | 11/2013 | Ito et al. | |
| 2002/0173185 | A1 | 11/2002 | Fukushima et al. | |
| 2011/0120846 | A1 | 5/2011 | Ito et al. | |
| 2012/0132508 | A1 | 5/2012 | Cyuzawa | |

FOREIGN PATENT DOCUMENTS

| | | | |
|---|---|---|---|
| JP | 57-7029 | A | 1/1982 |
| JP | 06-068753 | A | 3/1994 |
| JP | 2002-343169 | A | 11/2002 |
| JP | 2011-014313 | A | 1/2011 |
| JP | 2011-134698 | A | 7/2011 |

* cited by examiner 5
51
514
53
512
513
10b2
52
52a
9a
32
4
7
2
22
TB1
10b1
51a
54
10a
10
3
31
9
6
21
52g
52c
52e
55
52b
12
511
14
8
81
83a
52d
83b
51b
83
82
83c

DISCONNECTING SWITCH

RELATED APPLICATIONS

This application is the U.S. National Phase under 35 U.S.C. §371 of International Application No. PCT/JP2012/076531, filed on Oct. 12, 2012, which in turn claims the benefit of Japanese Application No. 2011-225960, filed on Oct. 13, 2011, and Japanese Application No. 2011-225963, filed Oct. 13, 2011, the disclosures of which are incorporated by reference herein.

TECHNICAL FIELD

The present invention relates to a disconnecting switch.

BACKGROUND ART

In the past, there has been proposed a manual disconnecting switch used for a circuit provided with a high-voltage battery (for example, see Japanese Patent Application Publication No. 2011-134698). This disconnecting switch includes: a contact part that is disposed in a closed vessel and that has a stationary contact and a movable contact configured to be brought into contact with and separate from the stationary contact freely; a shaft which is disposed so that a part thereof protrudes outward from the closed vessel; and a metal bellows for ensuring air tightness of the closed vessel. This disconnecting switch further includes: an open/close mechanism part configured to move the shaft back and forth freely between a closed contact position at which the movable contact is in contact with the stationary contact and an open contact position at which the movable contact is out of contact from the stationary contact; and a housing that houses above components. The open/close mechanism part is constituted by an operation lever which is disposed so that an operation portion thereof protrudes outward from the housing, and two rod-shaped arms which connect the operation lever and the shaft so as to move the shaft between the closed contact position and the open contact position according to an operation of the operation lever.

In this disconnecting switch, when the operation lever is positioned at an OFF position where the contact part is in an open contact state, the two arms are held in a state of forming a V-shape under an inner pressure of the closed vessel and a spring force of the metal bellows, and the contact part is thereby held in the open contact state. Further, when the operation lever is positioned at an ON position where the contact part is in a closed contact state, the two arms are held in a state of forming a reversed V-shape under the inner pressure of the closed vessel and the spring force of the metal bellows, and the contact part is thereby held in the closed contact state.

However, in the disconnecting switch shown in an above Patent Document 1, there has been a problem that the disconnecting switch has a large size because there needs a moving space for the two arms which connect the operation lever and the shaft and which are designed to rotate in opposite directions in conjunction with each other.

SUMMARY OF INVENTION

In view of the above problem, a present invention has aimed to provide a small disconnecting switch.

A disconnecting switch of the present invention includes a contact part that includes a stationary contact and a movable contact configured to be brought into contact with and separate from the stationary contact freely, a shaft configured to move the movable contact back and forth freely relative to the stationary contact, an open/close mechanism part configured to move the shaft back and forth freely between a closed contact position at which the movable contact is in contact with the stationary contact and an open contact position at which the movable contact is out of contact from the stationary contact, and a housing in which at least the contact part and the shaft is housed. The open/close mechanism part is constituted by an operation lever which is disposed so that an operation portion protrudes outward from the housing, an arm configured to rotate according to an operation of the operation lever to move the shaft between the open contact position and the closed contact position, and a wheel which is rotatably attached to the housing, and the arm is provided with a rotation slot in which the wheel is placed so that the wheel moves when the arm rotates.

In this disconnecting switch, a fusion detection part configured to detect a fusion of the contact part is constituted by the operation lever, the arm, and the wheel, and it is preferable that the wheel is brought into contact with a side wall of the rotation slot and restricts a rotational movement of the arm at an intermediate position when the arm rotates from an ON position to an OFF position in a state where the contact part is fused, and thereby the fusion detection part detects the fusion of the contact part.

Moreover, in this disconnecting switch, it is also preferable that the rotation slot is provided with an engaging protrusion configured to engage with the wheel in a state where the shaft is in the closed contact position.

Further, in this disconnecting switch, it is also preferable that the shaft is directly connected to the arm.

In this disconnecting switch, it is also preferable that the shaft includes a first end and a second end, the arm is rotatably connected to the first end of the shaft via a support shaft, the rotation slot includes a first end region and a second end region, and a distance between the first end region of the rotation slot and the support shaft is different from a distance between the second end region of the rotation slot and the support shaft, and that a relative distance between the wheel and the support shaft changes according to a movement of the wheel between the first end region and the second end region within the rotation slot, and thereby a rotation of the arm is converted into a movement of the shaft between the open contact position and the closed contact position.

According to the invention, it is possible to provide a small disconnecting switch.

BRIEF DESCRIPTION OF DRAWINGS

FIG. 1A is a schematic internal structure diagram of the disconnecting switch, FIG. 1B is a detailed view of a main part of FIG. 1A, and FIG. 1C is a schematic internal structure diagram of the disconnecting switch viewed from an opposite side of FIG. 1A;

FIG. 2A is a schematic internal structure diagram of the disconnecting switch, FIG. 2B is a detailed view of a main part of FIG. 2A, and FIG. 2C is a schematic internal structure diagram of the disconnecting switch viewed from an opposite side of FIG. 2A;

FIG. 3A is a schematic internal structure diagram of the disconnecting switch, and FIG. 3B is a detailed view of a main part of FIG. 3A;

DESCRIPTION OF EMBODIMENT

Figure 1C:
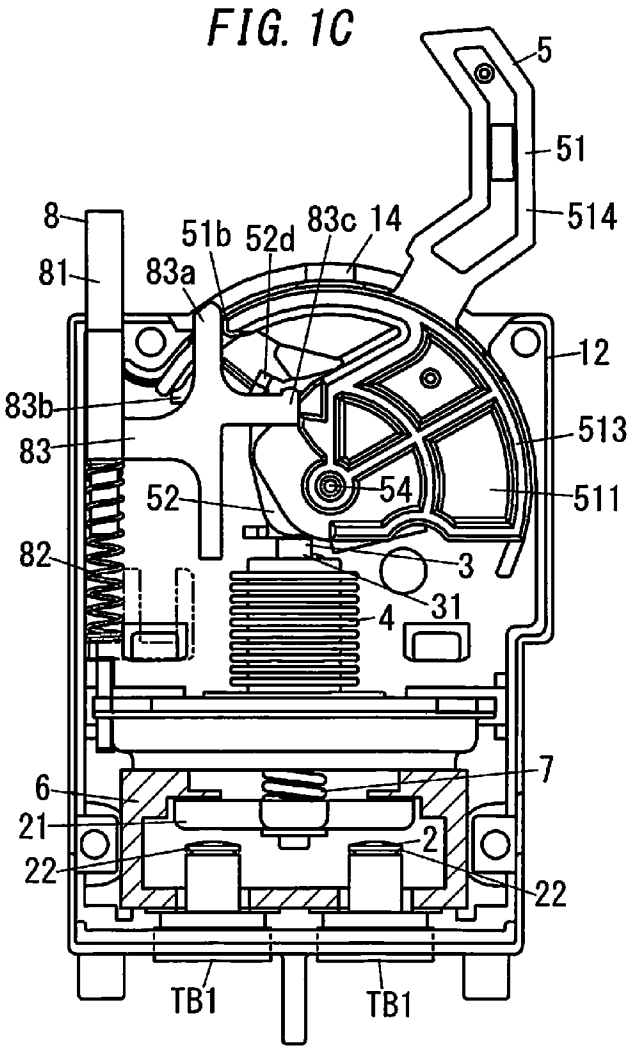
FIGS. 1A to 1C show a disconnecting switch according to a present embodiment in a state where a contact part is in an open contact position, where
Figure 1B:
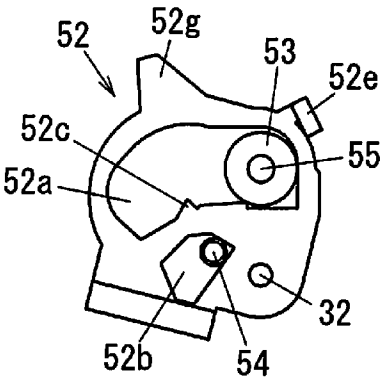
Figure 1A:
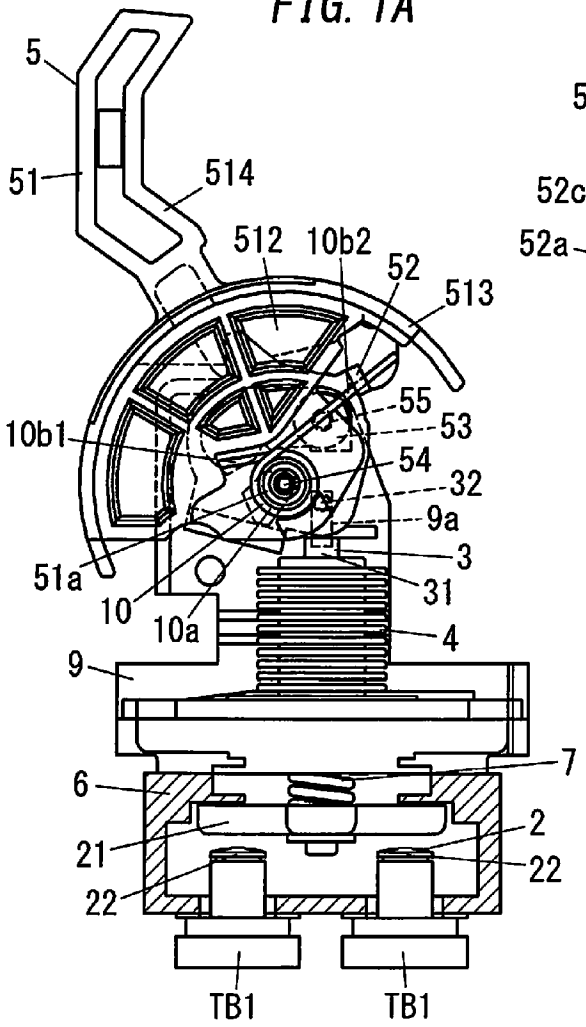
Figures 2A, 2B, 2C:
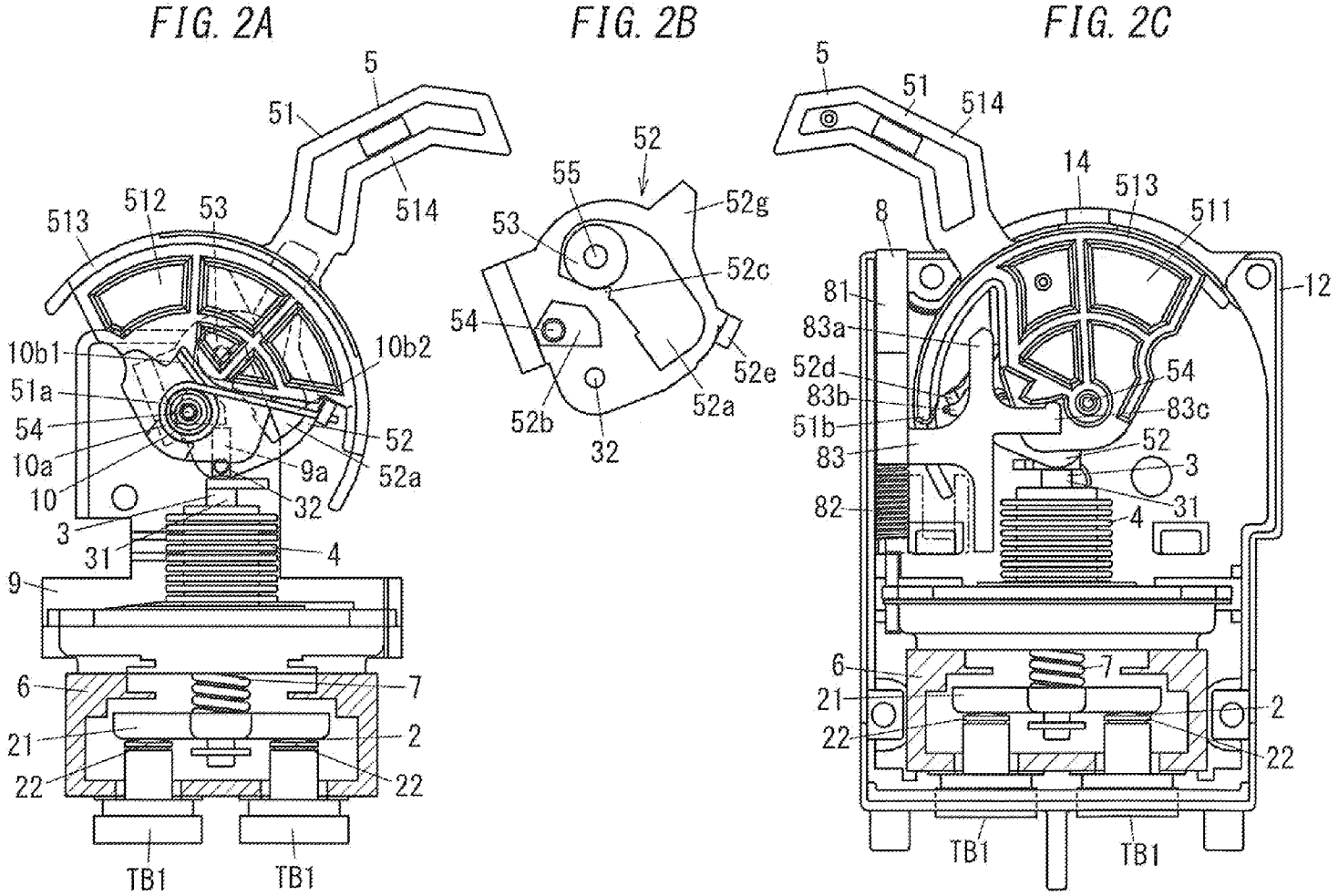
FIGS. 2A to 2C show the disconnecting switch according to the present embodiment in a state where the contact part is in an closed contact position, where

In the following, an embodiment of the disconnecting switch according to the present invention will be described with reference to FIG. 1A to FIG. 7. This disconnecting switch is a manual disconnecting switch, and is configured such that a contact part housed in a housing is opened and closed according to an operation of an operating lever provided at an upper surface side of the housing (a front surface side of the disconnecting switch). This disconnecting switch can be used for a circuit provided with a high-voltage battery, for example. FIG. 1C is an internal structure diagram in which the disconnecting switch shown in FIG. 1A is viewed from the opposite side, and FIG. 2C is an internal structure diagram in which the disconnecting switch shown in FIG. 2A is viewed from the opposite side.

The disconnecting switch according to the present embodiment includes a contact part 2, a shaft 3, a metal bellows 4, an open/close mechanism part 5, a regulating part 8, and a case 1 for housing these components which is made of synthetic resin, as main components. Further, the disconnecting switch according to the present embodiment includes a closed vessel 6 which houses the contact part 2, and a base member 9. In the present embodiment, the housing is constituted by the case 1 and the base member 9.

Figure 5:
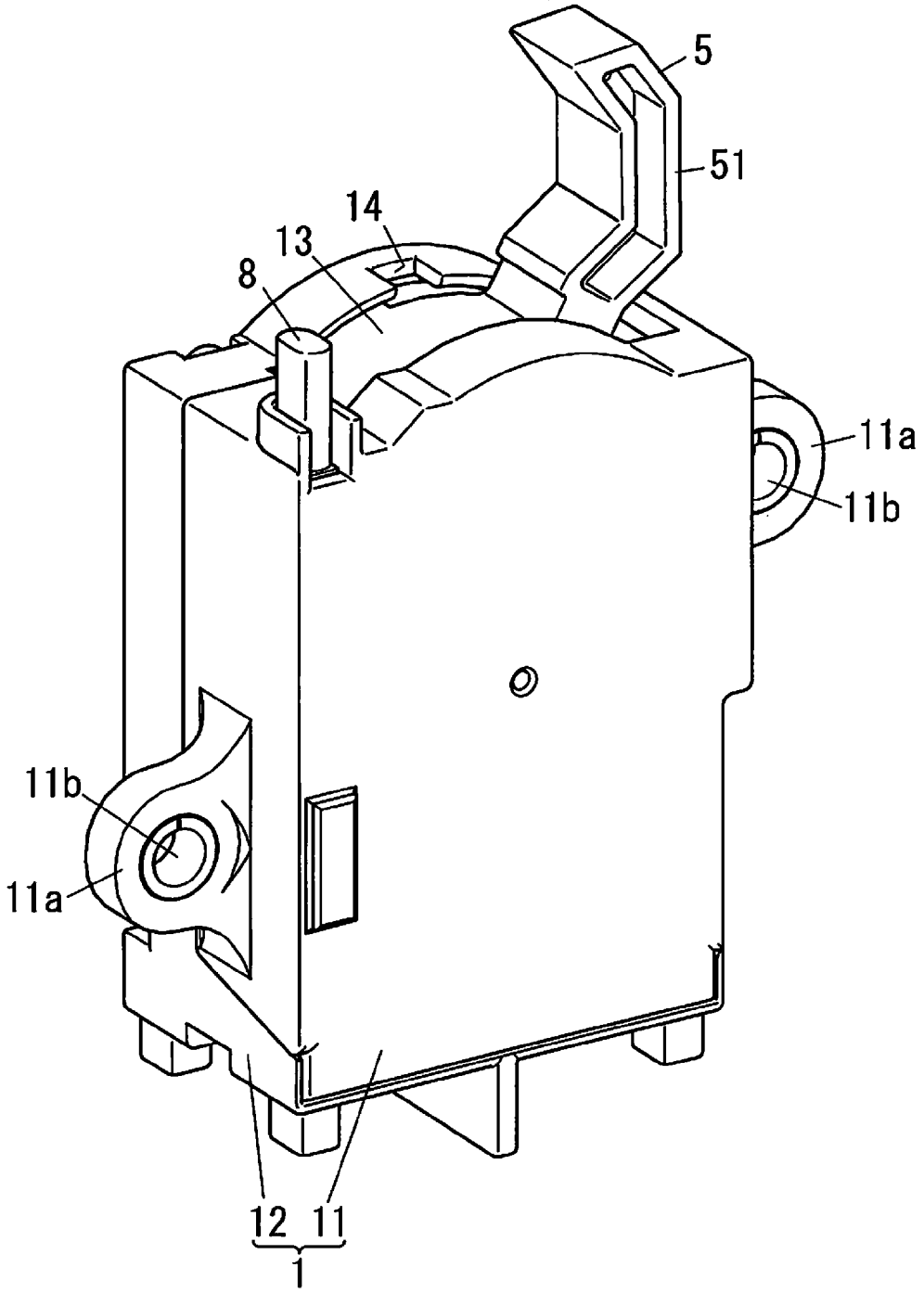
FIG. 5 is an external perspective view of the disconnecting switch according to the present embodiment.

The case 1 is, as shown in FIG. 5, constituted by housing pieces 11 and 12 (a first housing piece 11 and a second housing piece 12), each of which is shaped like a thin rectangular box with one open surface, and the case 1 is constituted by assembling the housing pieces 11 and 12 in a state where openings thereof face each other. The case 1 has a movement guide window 13 at an upper surface thereof (an upper surface shown in FIG. 5), in which an operation lever 51 of the open/close mechanism part 5 is placed so as to move freely, and further has a display window 14 which is formed continuously to the movement guide window 13. The display window 14 is for showing a state of the contact part 2 the state of which is changed in conjunction with an operation of the operation lever 51, and it is possible to grasp whether the contact part 2 is in an open contact state or in a closed contact state according to display contents (for example, "OFF" in the open contact state and "ON" in the closed contact state, and the like) shown in the display window 14. The housing piece 11 includes attachment pieces 11*a* at both opposite side walls in a width direction (a left and right direction in FIG. 5), respectively. Each of the attachment pieces 11*a* has a screw insertion hole 11*b* in which a fixing screw (not shown) is inserted to fix the disconnecting switch to an installation site (not shown). The base member 9 is attached inside the case 1.

The contact part 2 is, as shown in FIG. 1A to FIG. 3B, constituted by stationary contacts 22 and a movable contact 21, and housed in the closed vessel 6 in a state of ensuring air tightness. The stationary contacts 22 are provided at respective tips of a pair of stationary terminals TB1. The movable contact 21 is configured to be brought into contact with and separate from both stationary contacts 22 freely. Thus, the movable contact 21 is configured to electrically connect between the stationary contacts 22. In the present embodiment, although copper contacts are used for the stationary contacts 22 and the movable contact 21, other metal contacts may be used as well. Moreover, the stationary terminals TB1 also may be made by copper or other metal materials.

The shaft 3 is, as shown in FIG. 1A to FIG. 3B, formed of a rod 31 of which lengthwise direction corresponds to an upward and downward direction, and the movable contact 21 is attached at one end side of the rod 31 (a second end side of the rod 31; a second end side of the shaft 3; a lower end side in FIG.1A) so as to move freely in the upward and downward direction. Namely, the second end of the shaft 3 is connected to the movable contact 21. That is, the shaft 3 is configured to move the movable contact 21 back and forth freely relative to the stationary contacts 22. Further, the rod 31 is provided with a support shaft 32 integrally at the other end side of the rod 31 (a first end side of the rod 31; a first end side of the shaft 3; an upper end side in FIG.1A). The support shaft 32 supports an arm 52 (described below) so that the arm 52 can rotate freely. Namely, the arm 52 is rotatably connected to the first end of the shaft 3 via the support shaft 32.

The support shaft 32 is formed into a columnar shape which is long in a thickness direction of the case 1 (a direction perpendicular to a paper surface in FIG.1A). Further, the base member 9 (the housing) has a guide groove 9*a* which regulates a moving direction of the support shaft 32. The guide groove 9*a* is formed into a long shape in the upward and downward direction. An end of the support shaft 32 is inserted into the guide groove 9*a*, and the support shaft 32 moves in the upward and downward direction along the guide groove 9*a*. The shaft 3 is configured to move freely in the upward and downward direction between a closed contact position at which the movable contact 21 is in contact with the stationary contacts 22 (a position shown in FIGS. 2A to 2C) and an open contact position at which the movable contact 21 is out of contact from the stationary contacts 22 (a position shown in FIGS. 1A to 1C).

Further, in the present embodiment, the disconnecting switch is provided with a pressure spring 7 formed into a coil-shape and configured to bias the movable contact 21 that is attached at the front end side of the rod 31 toward the stationary contacts 22. Moreover, the disconnecting switch is provided with a flange (not shown) at an intermediate position in the upward and downward direction of the rod 31. An upper end in FIG. 2A (not shown) of the pressure spring 7 is fixed to this flange. A lower end in FIG. 2A of the pressure spring 7 is in contact with the movable contact 21 from an upper side. Thereby, in the closed contact state where the movable contact 21 is in contact with the stationary contacts 22 (a state where the shaft 3 is in a lower position), contacts 21 and 22 are held firmly in contact with each other due to a spring force of the pressure spring 7.

The metal bellows 4 is formed into a bellows shape as shown in FIG. 1A to FIG. 3B, and has a function of ensuring air tightness of the closed vessel 6. The metal bellows 4 has one end side in the upward and downward direction (a first end side of the metal bellows 4; a lower end side in FIG.1A) which is fixed around a portion of the closed vessel 6 where the shaft 3 protrudes from the closed vessel 6, and the other end side (a second end side of the metal bellows 4; an upper end side in FIG. 1A) which is fixed around a protruding portion of the shaft 3 (a portion of the shaft 3 exposed to an outside from the closed vessel 6). Thus, it is possible to ensure air tightness of the closed vessel 6 and also the shaft 3 can move freely relative to the closed vessel 6. Namely, the metal bellows 4 is configured to expand and contract freely in the upward and downward direction according to a movement of the shaft 3.

In detail, the closed vessel 6 has an insertion hole (not shown) at an upper surface (an upper surface in FIG. 1A) thereof. The shaft 3 is inserted in the insertion hole. The metal bellows 4 is shaped like a hollow bellows. The first end of the metal bellows 4 is fixed to the upper surface of the closed vessel 6 so as to cover the insertion hole. The second end of the metal bellows 4 is fixed to the rod 31 at a vicinity of the first end of the rod 31 so as to surround the rod 31 circumferentially. Thus, a closed space is formed by an inner part of the closed vessel 6 and an inner part of the metal bellows 4.

In the present embodiment, a gas containing hydrogen as a main component, is filled in the closed vessel 6. The main component of the gas is not limited to hydrogen, and may be nitrogen or carbon dioxide.

The open/close mechanism part 5 is, as shown in FIG. 1A to FIG. 3B, constituted by the operation lever 51, the arm (a link member) 52, and a wheel 53. The operation lever 51 is disposed so that an operation portion thereof protrudes outward from the case 1. The arm 52 is configured to rotate according to the operation of the operation lever 51 to move the shaft 3 between the open contact position and the closed contact position. The open/close mechanism part 5 is configured to move the shaft 3 back and forth freely between the closed contact position at which the movable contact 21 is in contact with the stationary contacts 22 and the open contact position at which the movable contact 21 is out of contact from the stationary contacts 22.

The operation lever 51 is rotatably attached to the base member 9 which is installed in the case 1, via a support shaft 54 which penetrates the operation lever 51 in a thickness direction thereof (the direction perpendicular to the paper surface in FIG. 1A. The wheel 53 is also rotatably attached to the base member 9 via a support shaft 55. Thus, the operation lever 51 is configured to rotate freely between an ON position (a position shown in FIG. 2A) where the shaft 3 is moved to the closed contact position and an OFF position (a position shown in FIG. 1A) where the shaft 3 is moved to the open contact position.

The arm 52 is rotatably connected to the shaft 3 via the support shaft 32 as described above. The arm 52 has a rotation slot 52*a* in which the wheel 53 is placed so that the wheel 53 can move, and a movement slot 52*b* in which the support shaft 54 is placed so that the shaft 54 can move, as shown in FIG. 1B and FIG. 2B. Further, the rotation slot 52*a* includes an engaging protrusion 52*c* that is configured to engage with the wheel 53 in a state where the shaft 3 is in the closed contact position. Then, in the state where the shaft 3 is in the closed contact position (see FIG. 2A), the arm 52 is held in a non-rotatable state (a state shown in FIG. 2B) with the wheel 53 engaging with the engaging protrusion 52*c*. The arm 52 is further provided with an abutment portion 52*d* integrally which is configured to abut on an abutment piece 83*b* included in a regulating body 83 (described below), as shown in FIG. 1C and FIG. 2C.

The rotation slot 52*a* includes a first end region 52*a*1 (a right end region in FIG. 1B) at which the wheel 53 is placed when the shaft 3 is in the open contact position, and a second end region 52*a*2 (a left end region in FIG. 2B) at which the wheel 53 is placed when the shaft 3 is in the closed contact position. A distance between the first end region 52*a*1 and the support shaft 32 is different from a distance between the second end region 52*a*2 and the support shaft 32 (in other words, a distance between a center of the wheel 53 and the support shaft 32 in a state where the wheel 53 is placed at the first end region 52*a*1, is different from a distance between the center of the wheel 53 and the support shaft 32 in a state where wheel 53 is placed at the second end region 52*a*2). In the present embodiment, the distance between the first end region 52*a*1 and the support shaft 32 is shorter than the distance between the second end region 52*a*2 and the support shaft 32. Accordingly, a relative distance between the wheel 53 and the support shaft 32 changes according to a movement of the wheel 53 between the first end region 52*a*1 and the second end region 52*a*2 within the rotation slot 52*a*. Thereby, in the present embodiment, a rotation of the arm 52 is converted into a movement of the shaft 3 between the open contact position and the closed contact position.

As shown in FIG. 1A and FIG. 1C, the operation lever 51 in the open/close mechanism part 5 of the present embodiment includes a first fan piece 511, a second fan piece 512, a partial cylinder piece 513, and an operating lug 514. The first fan piece 511 and the second fan piece 512 are facing each other in the direction perpendicular to the paper surface in FIG. 1A, and the first fan piece 511 is positioned at a side of the housing piece 11 and the second fan piece 512 is positioned at a side of a housing piece 12. The first fan piece 511 and the second fan piece 512 are integrally combined together via the partial cylinder piece 513. The operating lug 514 is integrally connected to the partial cylinder piece 513. In a vicinity of a connecting part of the operating lug 514 in the partial cylinder piece 513, a first rib (not shown) and a second rib (not shown) are formed on an inner surface of the partial cylinder piece 513. The first rib and the second rib each protrudes inward in a radial direction from the inner surface of the partial cylinder piece 513. The first rib protrudes from a left side of the operating lug 514 in FIG. 1A, and the second rib protrudes from a right side of the operating lug 514 in FIG. 1A. Further, the partial cylinder piece 513 is provided with displays such as "ON" and "OFF" on an outer side surface thereof. The support shaft 54 is arranged so as to penetrate centers of the first fan piece 511 and the second fan piece 512, and fixed to the housing. The operation lever 51 is configured to rotate about the support shaft 54 relative to the housing.

Figure 6:
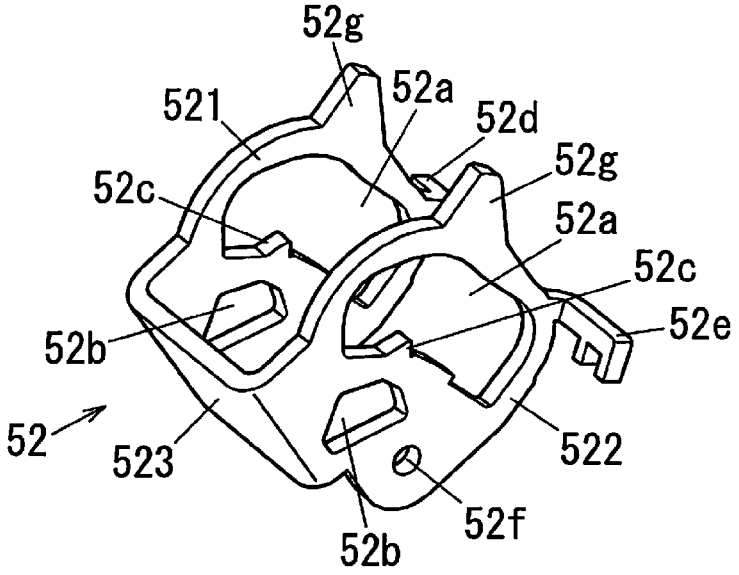
FIG. 6 is a perspective view of an arm that is included in the disconnecting switch according to the present embodiment.

As shown in FIG. 6, the arm 52 integrally includes a first arm piece 521 positioned at the side of the housing piece 11, a second arm piece 522 positioned at the side of the housing piece 12, and a connecting piece 523. The first arm piece 521 and the second arm piece 522 are integrally combined together via the connecting piece 523. Each of the first arm piece 521 and the second arm piece 522 has the rotation slot 52*a* and the movement slot 52*b*, and includes the engaging protrusion 52*c*. The abutment portion 52*d* is formed so as to protrude toward the housing piece 11 from an outer side surface of the first arm piece 521. The second arm piece 522 is provided at an outer side surface thereof with an engaging portion 52*e* which protrudes toward the housing piece 12. Each of the first arm piece 521 and the second arm piece 522 further has an insertion hole 52*f* in which the support shaft 32 is inserted. Each of the first arm piece 521 and the second arm piece 522 further includes a protruding piece 52*g*. The arm 52 is placed so that the protruding piece 52*g* is positioned between the first rib and the second rib of the operation lever 51. (That is, the protruding piece 52*g* is positioned at a right side of the first rib in FIG. 1A, and the protruding piece 52*g* is positioned at a left side of the second rib in FIG. 1A.)

Figure 7:
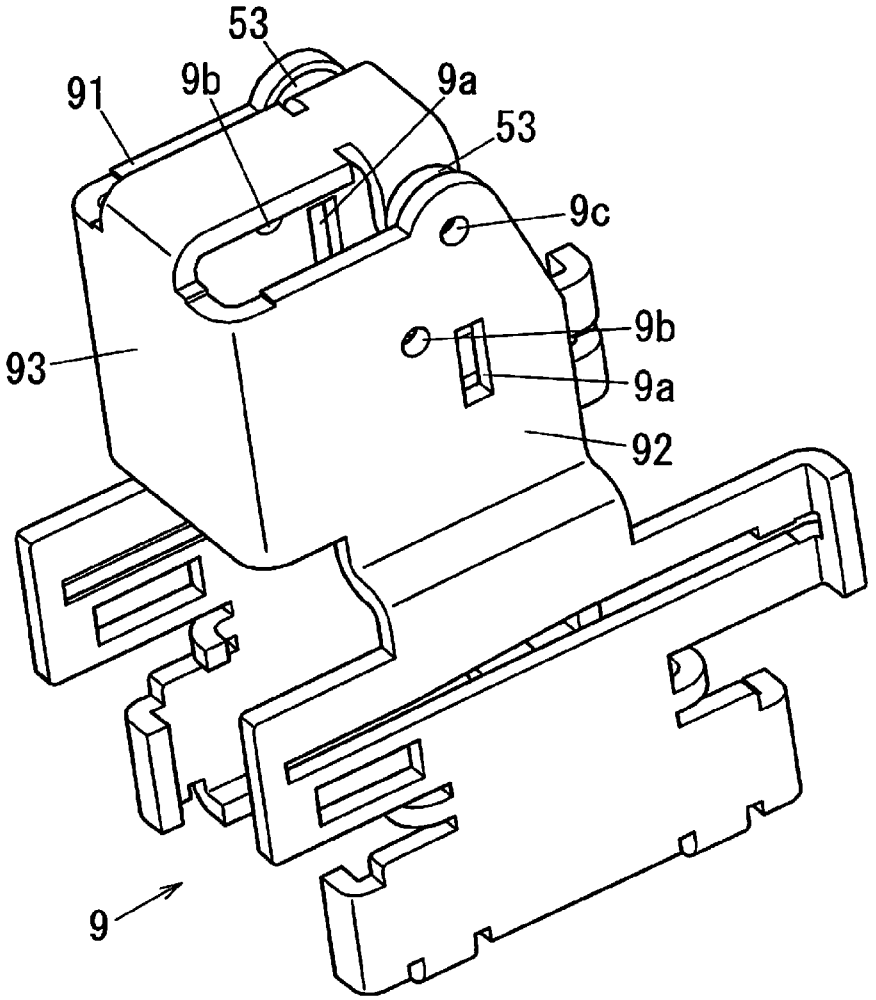
FIG. 7 is a perspective view of a base member that is included in the disconnecting switch according to the present embodiment.

Further as shown in FIG. 7, the base member 9 integrally includes a first plate 91 positioned at the side of the housing piece 11, a second plate 92 positioned at the side of the housing piece 12, and a connecting piece 93. The first plate 91 and the second plate 92 are integrally combined together via connecting piece 93. Each of the first plate 91 and the second plate 92 has the guide groove 9*a*. Each of the first plate 91 and the second plate 92 further has an insertion hole 9*b* in which the support shaft 54 is inserted. Each of the first plate 91 and the second plate 92 further has an insertion hole 9*c* in which the support shaft 55 is inserted, and the wheel 53 is attached to the base member 9 via the support shaft 55. Note that, among components of the base member 9, the first plate 91 is shown and the second plate 92 is not shown in FIG. 1A, FIG. 2A, and FIG. 3A. Further, the base member 9 is not shown in FIG. 1C and FIG. 2C.

Further in the present embodiment, the disconnecting switch is provided with a positioning spring 10 that restricts the operation lever 51 moving from the ON position (see FIGS. 2A to 2C) toward the OFF position (see FIGS. 1A to 1C). This positioning spring 10 includes a spring body 10*a* formed into a coil-shape, and integrally includes a pair of arms 10*b*1 and 10*b*2 (a first arm 10*b*1 and a second arm 10*b*2) which are extended in different directions to each other from both ends of the spring body 10*a*. The positioning spring 10 is biased in a direction that enlarges a diameter of the center hole thereof The operation lever 51 is provided, at one outer side surface in a penetrating direction (the direction perpendicular to the paper surface in FIG.1A) of the support shaft 54, with a spring attaching portion 51*a* which is shaped like a cylinder and which protrudes toward the penetrating direction. With inserting the spring attaching portion 51*a* into the center hole of the spring body 10*a*, and locking one arm 10*b*1 (the first arm 10*b*1) in a recess (not shown) formed in the operation lever 51 while attaching the other arm 102 (the second arm 10*b*2) to the arm 52 (to the engaging portion 52*e* of the second arm piece 522, in detail), the positioning spring 10 becomes attached to the operation lever 51 and the arm 52.

The regulating part 8 includes a lock button 81, a regulating body 83, and a return spring 82 as shown in FIG. 1C and FIG. 2C. The lock button 81 is formed into a bar shape and operated when releasing the restriction of the operation lever 51. The regulating body 83 is provided integrally with the lock button 81 and placed so as to be able to move back and forth freely between a restricting position (a position shown in FIG. 1C) in which a movement of the operation lever 51 is restricted, and a releasing position (a position shown in FIG. 2C) in which a restriction of the operation lever 51 is released. The return spring 82 biases the lock button 81 and the regulating body 83 toward the restricting position (upper sides in FIG. 1C and FIG. 2C). Moreover, the partial cylinder piece 513 of the operation lever 51 includes an abutment portion 51*b* at a side of the regulating part 8. The regulating body 83 includes a regulating piece 83*a* and the abutment piece 83*b*. The regulating piece 83*a* is configured to restrict the movement of the operation lever 51 by abutting on the abutment portion 51*b* included in the operation lever 51 in a state where the regulating body 83 is in the restricting position. The abutment piece 83*b* is configured to abut on the abutment portion 52*d* of the arm 52 in a state where the regulating body 83 is in the releasing position. The regulating body 83 further includes a regulating arm 83*c* which is configured to restrict a rotation of the operation lever 51 by abutting on a projection provided at an outer side surface of the first fan piece 511. Thus, the movement of the operation lever 51 is restricted in a state where the regulating piece 83*a* of the regulating body 83 is abutting on the abutment portion 51*b* of the operation lever 51, and a movement of the regulating part 8 is restricted in a state where the abutment piece 83*b* of the regulating body 83 is abutting on the abutment portion 52*d* of the arm 52. Moreover, the movement of the operation lever 51 is restricted in a state where the regulating arm 83*c* of the regulating part 8 is abutting on the projection of the operation lever 51.

Next, a movement of the disconnecting switch is described with reference to FIG. 1A to FIG. 3B. FIG. 1A shows a state in which the contact part 2 is opened (a state where the movable contact 21 is out of contact from the stationary contacts 22; the open contact state), and the wheel 53 is positioned at a right end of the rotation slot 52*a* of the arm 52 in FIG. 1B (the first end region 52*a*1) in this state. In this state, the regulating piece 83*a* of the regulating body 83 is abutting on the abutment portion 51*b* of the operation lever 51, and the regulating arm 83*c* is abutting on the projection of the operation lever 51, and therefore it is impossible to operate the operation lever 51 in this state (see FIG. 1C).

In order to shift the contact part 2 from the open contact state to the closed contact state (a state shown in FIG. 2A), a user should move the regulating body 83 to the releasing position by pushing the lock button 81 of the regulating part 8 downwardly first. When the user turns the operation lever 51 in a clockwise direction in FIG. 1A (a counterclockwise direction in FIG. 1C; a first rotating direction) while keeping the regulating body 83 at the releasing position, the protruding piece 52*g* of the arm 52 is pushed by the first rib of the operation lever 51 in a right direction in FIG. 1B. Thereby, the arm 52 rotates in a clockwise direction in FIG. 1B (the first rotating direction) about the support shaft 32, and the wheel 53 moves inside the rotation slot 52*a* of the arm 52 while rotating. When the user moves the operation lever 51 to the ON position (the position shown in FIG. 2A), the wheel 53 is moved to a left end of the rotation slot 52*a* in FIG. 2B (the second end region 52*a*2). At this time, due to the rotation of the arm 52 in the clockwise direction in FIG. 1A (the first rotating direction), the support shaft 32 is moved downward along the guide groove 9*a* and the shaft 3 is pushed downward. Thereby, the contact part 2 becomes into the closed contact state shown in FIG. 2A (a state where the movable contact 21 is in contact with the stationary contacts 22).

In the state shown in FIG. 2A, the movable contact 21 is held firmly in contact with the stationary contacts 22 by a spring force of the pressure spring 7. In this state, the arm 52 is applied with an upward force via the shaft 3 from the pressure spring 7. The arm 52 is held in a non-rotatable state without rotating in an open contact direction because the wheel 53 engages with the engaging protrusion 52*c* of the rotation slot 52*a* as shown in FIG. 2B. Further in this state, the operation lever 51 is held in the ON position because the operation lever 51 is applied with a spring force toward a clockwise direction in FIG. 2A (a spring force toward the first rotating direction) by the positioning spring 10. In this state, the lock button 81 integrally provided at the regulating body 83 is held to be pushed into the case 1 because the abutment piece 83*b* of the regulating body 83 is abutting on the abutment portion 52*d* of the arm 52 and thereby an upward movement of the regulating body 83 is restricted by the arm 52 (see FIG. 2C). Further, a display of "ON" which is formed on the outer side surface of the partial cylinder piece 513 of the operation lever 51 is shown through the display window 14.

On the other hand, when the user turns the operation lever 51 from a position of the closed contact state shown in FIG. 2A in a counterclockwise direction in FIG. 2A (a second rotating direction), since the protruding piece 52*g* of the arm 52 is pushed by the second rib of the operation lever 51 in a left direction in FIG. 2B, the arm 52 rotates and thereby the wheel 53 climbs over the engaging protrusion 52*c*. Thereafter, the arm 52 rotates in a counterclockwise direction in FIG. 2B (the second rotating direction), about the support shaft 32, and the wheel 53 moves inside the rotation slot 52*a* of the arm 52 while rotating. When the user moves the operation lever 51 to the OFF position (the position shown in FIG. 1A), the wheel 53 is moved to a right end of the rotation slot 52*a* in FIG. 1B (the first end region 52*a*1). At this time, due to the rotation of the arm 52 in the counterclockwise direction in FIG. 2B (the second rotating direction), the shaft 3 is pulled upward, and thereby the contact part 2 becomes into the open contact state shown in FIG. 1A.

In the state shown in FIG. 1A, the arm 52 is held in a non-rotatable state without rotating in a closed contact direction due to receiving an inner pressure of the closed vessel 6 and a spring force of the metal bellows 4. Further in this state, an abutting state of the abutment portion 52*d* of the arm 52 and the abutment piece 83*b* of the regulating body 83 is released (that is, a restriction to the regulating body 83 of the arm 52 is released), and thereby the lock button 81 and the regulating body 83 is returned to the restricting position receiving a spring force of the return spring 82, and as a result the movement of the operation lever 51 is restricted (see FIG. 1C). In this state, the operation lever 51 is applied with a spring force toward the clockwise direction in FIG. 1A (the spring force toward the first rotating direction) from the positioning spring 10, and the operation lever 51 will attempt to rotate in the clockwise direction in FIG. 1A (the first rotating direction). However, the movement of the operation lever 51 is restricted because the operation lever 51 is abutting on the arm 52 of which position is held by the inner pressure of the closed vessel 6 and a spring force of the metal bellows 4 (because the first rib of the operation lever 51 is abutting on the protruding piece 52*g* of the arm 52, in detail), and thereby the operation lever 51 is held in the OFF position. Further, a display of "OFF" which is formed on the outer side surface of the partial cylinder piece 513 of the operation lever 51 is shown through the display window 14.

Figure 3A:
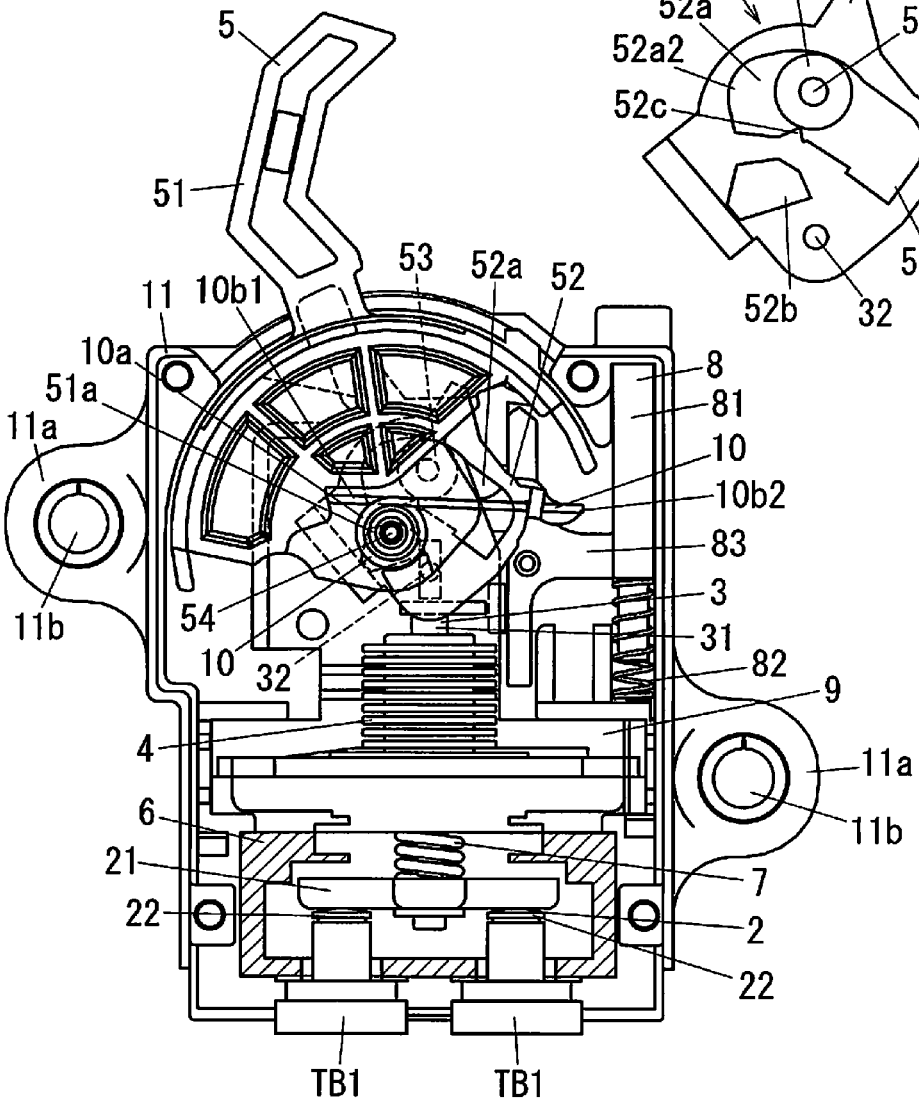
FIGS. 3A to 3B show the disconnecting switch according to the present embodiment in a state where the contact part is fused, where
Figure 3B:
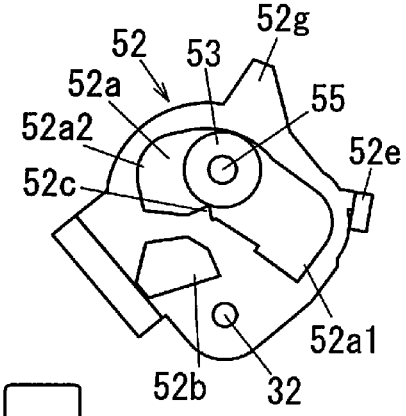

Next, FIG. 3A shows a state where the contact part 2 is fused due to an overcurrent, for example. In the state where the contact part 2 is fused, when the operation lever 51 and the arm 52 attempt to rotate in the counterclockwise direction in FIG. 2A (the second rotating direction) receiving a manual force or a force from a mechanical mechanism, the shaft 3 cannot move upper than a state shown in FIG. 3A, and thereby the arm 52 can only rotate up to a position shown in FIG. 3B, because of the fusion of the contact part 2. That is, the wheel 53 is brought into contact with a side wall of the rotation slot 52*a* and restricts a rotational movement of the arm 52 at an intermediate position (a position between a position that makes the contact part 2 open and a position that makes the contact part 2 closed) as shown in FIG. 3B. At this time, even though the user tries to turn the operation lever 51 to the OFF position, but the operation lever 51 can only move up to a position shown in FIG. 3A, due to a spring force of the positioning spring 10 or the second rib abutting on the protruding piece 52*g*. On the other hand, the upward movement of the regulating body 83 is restricted by the arm 52 in a state shown in FIG. 3A, and accordingly a rotation in a clockwise direction in FIG. 3A (the first rotating direction) of the operation lever 51 is restricted, because the regulating arm 83*c* of the regulating body 83 is abutting on the projection of the first fan piece 511. As a result, the operation lever 51 is held in the position shown in FIG. 3A. In this state, the display of "ON" (or "FUSION") which is formed on the outer side surface of the partial cylinder piece 513 of the operation lever 51 is shown through the display window 14.

The disconnecting switch may include a trip mechanism configured to turn the operation lever 51 in the counterclockwise direction in FIG. 2A, (the second rotating direction) before the contact part 2 causes a fusion.

Figure 4:
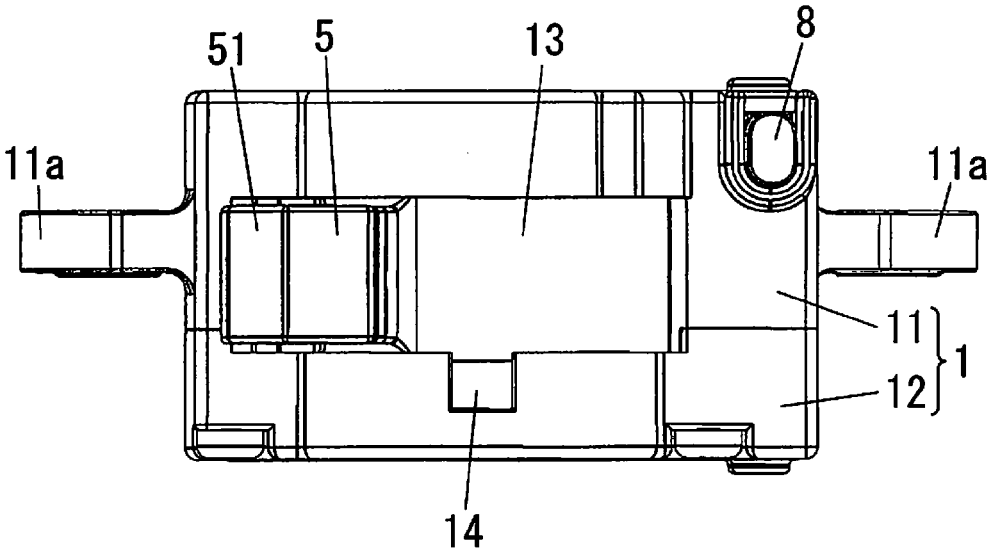
FIG. 4 is a top view of the disconnecting switch according to the present embodiment.

Incidentally, in the state of fusion described above, upward movement of the lock button 81 and the regulating body 83 is restricted by the arm 52 as shown in FIG. 3A, as described above. Accordingly, it is possible to detect the fusion of the contact part 2 from that the lock button 81 is positioned at the releasing position (a position shown in FIG. 3A) and that the operation lever 51 is positioned at a position close to the OFF position (the position shown in FIG. 3A). Further in the present embodiment, the display window 14 is formed on an upper surface of the case 1 as shown in FIG. 4, and it is possible to detect the fusion of the contact part 2 by checking a display of the display window 14.

Further in the state of fusion, when the user tries to turn the operation lever 51 from the ON position to the OFF position in the counterclockwise direction in FIG. 2A (the second rotating direction), an upper portion of the wheel 53 and the side wall of the rotation slot 52*a* are brought into abutting on each other as shown in FIG. 3B in a middle of its rotation. Even though the user further tries to turn the operation lever 51 from this state in a direction toward the OFF position (a counterclockwise direction in FIG. 3A), the wheel 53 cannot move in the rotation slot 52*a* while the upper portion of the wheel 53 and an inner surface of the rotation slot 52*a* are merely pushing each other, and thereby the operation lever 51 cannot be turned in the direction toward the OFF position any further. That is, it is possible for the user to know that the fusion of the contact part 2 is occurring from the state of the operation lever 51 that cannot be turned any further than the position shown in FIG. 3A.

In the present embodiment, a fusion detection part is constituted by the operation lever 51, the arm 52, and the wheel 53.

According to the present embodiment, since there can only have a space for one arm 52 to rotate and there is no need to have a space for two arms to move like conventional examples, it is possible to provide a small disconnecting switch relative to conventional examples. Moreover, it is possible to provide the small disconnecting switch that is possible to detect the fusion of the contact part 2 by the operation lever 51, the arm 52, and the wheel 53. Further, it is possible to hold the shaft 3 in the closed contact position and keep the closed contact state of the contact part 2 by engaging the wheel 53 with the engaging protrusion 52*c* formed in the rotation slot 52*a* of the arm 52. In a configuration in which the shaft 3 is directly connected to the arm 52 like the present embodiment, it is possible to reduce parts that connect the shaft 3 and the arm 52 with each other, and moreover, it is possible to reliably convey a small change such as the fusion of the contact part 2 to the arm 52, by connecting the shaft 3 and the arm 52 directly with each other.

According to the present embodiment, there is no need to include a latch mechanism that is generally included in a conventional disconnecting switch, because the abutment piece 83*b* of the regulating body 83 abuts on the abutment portion 52*d* of the arm 52 and the regulating body 83 is held in the releasing position when the operation lever 51 is in the ON position. Accordingly, it is possible to reduce a number of parts and improve assembling workability. Moreover, it is possible to reduce a size of the case 1 in which parts of the disconnecting switch are housed, and therefore it is also possible to reduce a size of the disconnecting switch.

Although it has been shown a structure of the operation lever 51 that includes a pair of fan pieces 511 and 512 in the present embodiment, the operation lever 51 may not include the first fan piece 511. Further, although it has been shown a structure in which the arm 52 includes a pair of arm pieces 521 and 522 and each of the arm pieces 521 and 522 is provided with a wheel 53, it may be a structure in which the arm 52 only includes the first arm piece 521 (or a structure in which the arm 52 only includes the second arm piece 522).

Moreover, structures (shapes) of an arm and a wheel are not limited to the present embodiment, and it may be another structure as long as the wheel is configured to move inside a rotation slot formed in the arm while rotating.

The invention claimed is:

1. A disconnecting switch comprising:

a contact part that includes a stationary contact and a movable contact configured to be brought into contact with and separate from the stationary contact freely;

a shaft configured to move the movable contact back and forth freely relative to the stationary contact;

an open/close mechanism part configured to move the shaft back and forth freely between a closed contact position at which the movable contact is in contact with the stationary contact and an open contact position at which the movable contact is out of contact from the stationary contact; and a housing in which at least the contact part and the shaft is housed, wherein the open/close mechanism part includes an operation lever which is disposed so that an operation portion thereof protrudes outward from the housing, an arm configured to rotate according to an operation of the operation lever to move the shaft between the open contact position and the closed contact position, and a wheel which is rotatably attached to the housing, and the arm is provided with a rotation slot in which the wheel is placed so that the wheel moves when the arm rotates.

2. The disconnecting switch according to claim 1, wherein a fusion detection part configured to detect a fusion of the contact part is constituted by the operation lever, the arm, and the wheel, and the wheel is brought into contact with a side wall of the rotation slot and restricts a rotational movement of the arm at an intermediate position when the arm rotates from an ON position to an OFF position in a state where the contact part is fused, and thereby the fusion detection part detects the fusion of the contact part.

3. The disconnecting switch according to claim 1, wherein the rotation slot is provided with an engaging protrusion that engages with the wheel in a state where the shaft is in the closed contact position.

4. The disconnecting switch according to claim 1, wherein the shaft is directly connected to the arm.

5. The disconnecting switch according to claim 1, wherein the shaft includes a first end and a second end, the arm is rotatably connected to the first end of the shaft via a support shaft, the rotation slot includes a first end region and a second end region, and a distance between the first end region of the rotation slot and the support shaft is different from a distance between the second end region of the rotation slot and the support shaft, and a relative distance between the wheel and the support shaft changes according to a movement of the wheel between the first end region and the second end region within the rotation slot, and thereby a rotation of the arm is converted into a movement of the shaft between the open contact position and the closed contact position.

6. The disconnecting switch according to claim 2, wherein the rotation slot is provided with an engaging protrusion that engages with the wheel in a state where the shaft is in the closed contact position.

7. The disconnecting switch according to claim 2, wherein the shaft is directly connected to the arm.

8. The disconnecting switch according to claim 3, wherein the shaft is directly connected to the arm.

9. The disconnecting switch according to claim 6, wherein the shaft is directly connected to the arm.

* * * * *